US008833077B2

(12) United States Patent
Kalina

(10) Patent No.: US 8,833,077 B2
(45) Date of Patent: Sep. 16, 2014

(54) SYSTEMS AND METHODS FOR LOW TEMPERATURE HEAT SOURCES WITH RELATIVELY HIGH TEMPERATURE COOLING MEDIA

(75) Inventor: Alexander I. Kalina, Hillsborough, CA (US)

(73) Assignee: KALEX, LLC, Belmont, CA (US)

( * ) Notice: Subject to any disclaimer, the term of this patent is extended or adjusted under 35 U.S.C. 154(b) by 156 days.

(21) Appl. No.: 13/475,541

(22) Filed: May 18, 2012

(65) Prior Publication Data

US 2013/0305721 A1 Nov. 21, 2013

(51) Int. Cl.
*F01K 25/06* (2006.01)

(52) U.S. Cl.
USPC ..... 60/649; 60/651; 60/653; 60/670; 60/671

(58) Field of Classification Search
USPC ..... 60/649, 651, 653, 670, 671
See application file for complete search history.

(56) References Cited

U.S. PATENT DOCUMENTS

| | | | | |
|---|---|---|---|---|
| 3,146,761 | A | 9/1964 | Blodgett | |
| 3,696,587 | A | 10/1972 | Young et al. | |
| 3,712,073 | A | 1/1973 | Arenson | |
| 3,867,907 | A | 2/1975 | Marsch et al. | |
| 3,979,914 | A | 9/1976 | Weber | |
| 4,010,246 | A | 3/1977 | Steinrotter et al. | |
| 4,164,849 | A | 8/1979 | Mangus | |
| 4,183,225 | A | 1/1980 | Politte et al. | |
| 4,324,102 | A | 4/1982 | Woinsky | |
| 4,326,581 | A | 4/1982 | Rapier | |
| 4,346,561 | A | 8/1982 | Kalina | 60/673 |
| 4,433,545 | A | 2/1984 | Chang | |
| 4,442,679 | A | 4/1984 | Stafford et al. | |
| 4,489,563 | A | 12/1984 | Kalina | 60/673 |
| 4,548,043 | A | 10/1985 | Kalina | 60/673 |
| 4,586,340 | A | 5/1986 | Kalina | 60/673 |
| 4,604,867 | A | 8/1986 | Kalina | 60/653 |
| 4,619,809 | A | 10/1986 | Schluderberg | |
| 4,674,285 | A | 6/1987 | Durrant et al. | |
| 4,704,877 | A | 11/1987 | Selcukoglu | |
| 4,732,005 | A | 3/1988 | Kalina | 60/673 |
| 4,739,713 | A | 4/1988 | Vier et al. | |
| 4,753,758 | A | 6/1988 | Miller | |
| 4,763,480 | A | 8/1988 | Kalina | 60/649 |
| 4,817,392 | A | 4/1989 | Agrawal et al. | |
| 4,819,437 | A | 4/1989 | Dayan | |
| 4,832,718 | A | 5/1989 | Mehra | |
| 4,899,545 | A | 2/1990 | Kalina | 60/673 |
| 4,982,568 | A | 1/1991 | Kalina | 60/649 |
| 5,019,143 | A | 5/1991 | Mehrta | |
| 5,029,444 | A | 7/1991 | Kalina | 60/673 |
| 5,038,567 | A | 8/1991 | Mortiz | |

(Continued)

OTHER PUBLICATIONS

U.S. Appl. No. 11/227,991, filed Sep. 15, 2005, Kalina.

(Continued)

*Primary Examiner* — Thomas Denion
*Assistant Examiner* — Xiaoting Hu
(74) *Attorney, Agent, or Firm* — Robert W Strozier

(57) ABSTRACT

Methods and systems for implementing a thermodynamic cycle using heat source streams having initial temperatures between about 200° F. and about 500° F. and coolant stream having relatively high temperatures greater than or equal to about 80° F., where the methods and systems have overall energy extraction efficiencies that are at least 40% higher than a corresponding Rankine cycle.

9 Claims, 1 Drawing Sheet

(56) References Cited

U.S. PATENT DOCUMENTS

| | | | | |
|---|---|---|---|---|
| 5,095,708 | A | 3/1992 | Kalina | 60/673 |
| 5,103,899 | A | 4/1992 | Kalina | 165/104.13 |
| 5,440,882 | A | 8/1995 | Kalina | 60/641.2 |
| 5,450,821 | A | 9/1995 | Kalina | 122/1 R |
| 5,572,871 | A | 11/1996 | Kalina | 60/649 |
| 5,588,298 | A | 12/1996 | Kalina et al. | 60/676 |
| 5,603,218 | A | 2/1997 | Hooper | |
| 5,649,426 | A | 7/1997 | Kalina et al. | 60/649 |
| 5,754,613 | A | 5/1998 | Hashiguchi et al. | |
| 5,784,888 | A | 7/1998 | Termeuhlen | |
| 5,797,981 | A | 8/1998 | Collin et al. | |
| 5,822,990 | A | 10/1998 | Kalina et al. | 60/649 |
| 5,893,410 | A | 4/1999 | Halbrook | |
| 5,950,433 | A | 9/1999 | Kalina et al. | 60/649 |
| 5,953,918 | A | 9/1999 | Kalina et al. | 60/653 |
| 6,015,451 | A | 1/2000 | Anderson et al. | |
| 6,035,642 | A | 3/2000 | Peletz et al. | |
| 6,058,695 | A | 5/2000 | Ranasinghe et al. | |
| 6,065,280 | A | 5/2000 | Ranasinghe et al. | |
| 6,158,220 | A | 12/2000 | Hansen et al. | |
| 6,158,221 | A | 12/2000 | Fancher et al. | |
| 6,167,705 | B1 | 1/2001 | Hansen et al. | |
| 6,170,263 | B1 | 1/2001 | Chow et al. | |
| 6,195,998 | B1 | 3/2001 | Hansen et al. | |
| 6,202,418 | B1 | 3/2001 | Gabrielli et al. | |
| 6,223,535 | B1 | 5/2001 | Kitz | |
| 6,347,520 | B1 | 2/2002 | Ranasinghe et al. | |
| 6,464,492 | B1 | 10/2002 | Guarco et al. | 432/91 |
| 6,735,948 | B1 | 5/2004 | Kalina | 60/649 |
| 6,769,256 | B1 | 8/2004 | Kalina | 60/653 |
| 6,820,421 | B2 | 11/2004 | Kalina | 60/649 |
| 6,829,895 | B2 | 12/2004 | Kalina | 60/649 |
| 6,910,334 | B2 | 6/2005 | Kalina | 60/651 |
| 6,923,000 | B2 | 8/2005 | Kalina | 60/649 |
| 6,941,757 | B2 | 9/2005 | Kalina | 60/649 |
| 6,968,690 | B2 | 11/2005 | Kalina | 60/649 |
| 7,021,060 | B1 | 4/2006 | Kalina | 60/649 |
| 7,043,919 | B1 | 5/2006 | Kalina | 60/651 |
| 7,055,326 | B1 | 6/2006 | Kalina | 60/649 |
| 7,065,967 | B2 | 6/2006 | Kalina | 60/649 |
| 7,065,969 | B2 | 6/2006 | Kalina | 60/670 |
| 7,104,784 | B1 | 9/2006 | Hasegawa et al. | 431/4 |
| 7,197,876 | B1 | 4/2007 | Kalina | 60/649 |
| 7,264,654 | B2 | 9/2007 | Kalina | 95/228 |
| 7,350,471 | B2 | 4/2008 | Kalina | 110/348 |
| 7,398,651 | B2 | 7/2008 | Kalina | 60/649 |
| 7,516,619 | B2 * | 4/2009 | Pelletier | 60/649 |
| 2003/0154718 | A1 | 8/2003 | Nayar | |
| 2003/0167769 | A1 | 9/2003 | Bharathan | |
| 2004/0050048 | A1 | 3/2004 | Kalina | |
| 2004/0055302 | A1 | 3/2004 | Kalina | |
| 2004/0069015 | A1 | 4/2004 | Paradowski | |
| 2004/0148935 | A1 | 8/2004 | Kalina | |
| 2004/0182084 | A1 | 9/2004 | Kalina | |
| 2005/0050891 | A1 | 3/2005 | Kalina | |
| 2005/0061654 | A1 | 3/2005 | Kalina | 203/21 |
| 2005/0066661 | A1 | 3/2005 | Kalina | |
| 2005/0183418 | A1 * | 8/2005 | Kalina | 60/517 |
| 2005/0235645 | A1 | 10/2005 | Kalina | |
| 2006/0096288 | A1 | 5/2006 | Kalina | 60/649 |
| 2006/0096289 | A1 | 5/2006 | Kalina | |
| 2006/0096290 | A1 | 5/2006 | Kalina | 60/649 |
| 2006/0165394 | A1 | 7/2006 | Kalina | 392/386 |
| 2006/0199120 | A1 | 9/2006 | Kalina | 431/9 |
| 2007/0056284 | A1 | 3/2007 | Kalina | |
| 2007/0068161 | A1 | 3/2007 | Kalina | |
| 2007/0234722 | A1 | 10/2007 | Kalina | |
| 2007/0234750 | A1 | 10/2007 | Kalina | |
| 2008/0000225 | A1 | 1/2008 | Kalina | |
| 2008/0053095 | A1 | 3/2008 | Kalina | |
| 2010/0083662 | A1 | 4/2010 | Kalina | |
| 2010/0101227 | A1 | 4/2010 | Kalina | |
| 2010/0122533 | A1 | 5/2010 | Kalina | |
| 2010/0146973 | A1 | 6/2010 | Kalina | |
| 2010/0205962 | A1 | 8/2010 | Kalina | |
| 2011/0024084 | A1 | 2/2011 | Kalina | |
| 2011/0067400 | A1 | 3/2011 | Kalina | |
| 2011/0174296 | A1 | 7/2011 | Kalina | |

OTHER PUBLICATIONS

U.S. Appl. No. 11/235,654, filed Sep. 22, 2005, Kalina.
U.S. Appl. No. 11/238,173, filed Sep. 28, 2005, Kalina.
U.S. Appl. No. 11/399,287, filed Apr. 5, 2006, Kalina.
U.S. Appl. No. 11/399,306, filed Apr. 5, 2006, Kalina.
U.S. Appl. No. 11/514,290, filed Aug. 31, 2006, Kalina.

* cited by examiner

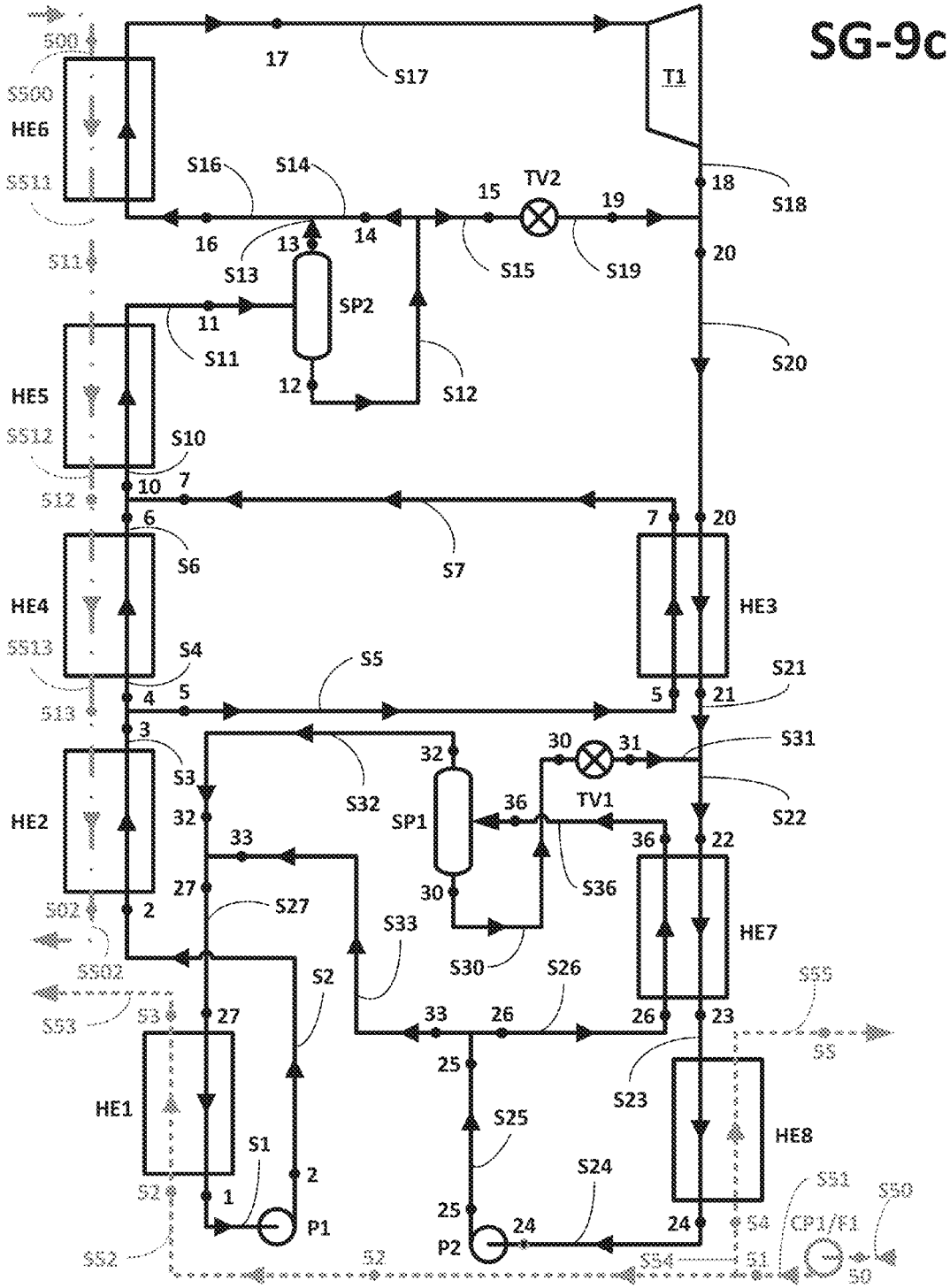
SG-9c
T1
HE1
HE2
HE3
HE4
HE5
HE6
HE7
HE8
SP1
SP2
TV1
TV2
P1
P2
CP1/F1
S0
S1
S2
S3
S4
S5
S6
S7
S10
S11
S12
S13
S14
S15
S16
S17
S18
S19
S20
S21
S22
S23
S24
S25
S26
S27
S30
S31
S32
S33
S36
SS0
SS1
SS2
SS3
SS4
SS5
SS11
SS12
SS13
SS02
SS53
S00
S02
S12
S13
S3
S53
S55
S51
S50
S54
S2
S1
S5
1
2
3
4
5
6
7
10
11
12
13
14
15
16
17
18
19
20
21
22
23
24
25
26
27
30
31
32
33
36

SYSTEMS AND METHODS FOR LOW TEMPERATURE HEAT SOURCES WITH RELATIVELY HIGH TEMPERATURE COOLING MEDIA

BACKGROUND OF THE INVENTION

1. Field of the Invention

Embodiments of the present invention relate to systems designed for utilizing of heat source streams having an initial temperature between about 200° F. and about 500° F., such as geothermal heat sources and other heat sources with a similar temperature range.

More particularly, embodiments of the present invention relate to systems designed for utilizing of heat sources streams having an initial temperatures between about 200° F. and about 500° F., such as geothermal heat sources and other heat sources with similar a temperature range, where the system includes a two staged condensation subsystem. The system is specifically designed for use in applications, where the temperatures of cooling water or air are relatively high, e.g., 80° F. or higher. This makes the system well suited for use in geothermal applications in tropical and subtropical climates.

2. Description of the Related Art

In U.S. Pat. No. 4,982,568, a working fluid is a mixture of at least two components with different boiling temperatures. The high pressure at which this working fluid vaporizes and the pressure of the spent working fluid (after expansion in a turbine) at which the working fluid condenses are chosen in such a way that the initial temperature of condensation is higher than the initial temperature of boiling. Therefore, it is possible that the initial boiling of the working fluid is achieved by recuperation of heat released in the process of the condensation of the spent working fluid. But in a case where the initial temperature of the heat source used is moderate or low, the range of temperatures of the heat source is narrow, and therefore, the possible range of such recuperative boiling-condensation is significantly reduced and the efficiency of the system described in the prior art diminishes.

U.S. Pat. Nos. 6,769,256, 6,941,757, 6,910,334 and 7,065,969 disclosed modified versions of the systems set forth above.

Thus, there is a need in the art for a new thermodynamic cycle and a system based thereon for enhanced energy utilization and conversion.

SUMMARY OF THE INVENTION

Methods

Embodiments of the present invention provide methods for extracting thermal energy from heat source streams having initial temperatures between about 200° F. and about 500° F., where coolant stream used to condense cycle streams have relatively high temperatures greater than or equal to about 80° F., where the methods have overall energy extraction efficiencies that are at least 40% higher than a corresponding Rankine cycle and at least 10% higher than inventor's prior cycle SG-2c disclosed in U.S. Pat. Nos. 6,769,256, 6,941,757, 6,910,334 and 7,065,969.

Vaporizing Steps

The methods include partially vaporizing a fully condensed higher pressure rich solution stream using heat from a heat source stream and a spent rich solution stream in a plurality of heat exchange stages, separating the partially vaporized higher pressure rich solution stream in a first gravity separator into a first rich vapor stream and a first lean liquid stream and adjusting a liquid content of the first rich vapor stream by adding a portion of the first lean liquid stream into the first rich vapor stream to form a richer solution stream so that a quantity of the richer solution stream may be increased improving the overall energy extraction efficiencies of the methods as set forth above. The methods then include fully vaporizing and slightly superheating the richer solution stream, converting a portion of the heat associated with the vaporized and slightly superheated richer solution stream into a useable form of energy with the improved efficiencies, and combining a pressure adjusted remainder of the first lean liquid stream into a spent richer solution stream to from the spent rich solution stream.

Condensing Steps

The methods also include fully condensing an intermediate solution stream and fully condensing a rich solution stream using a pressurized coolant stream. The methods also include increasing a pressure of the fully condensed rich solution stream to form a fully condensed higher pressure rich solution stream and increasing a pressure of the fully condensed intermediate solution stream to form a fully condensed pressurized intermediate solution stream having a pressure slightly higher than the pressure of the fully condensed higher pressure rich solution stream. The methods also include partially vaporizing a first pressurized intermediate solution substream with heat from an intermediate solution stream formed from a cooled spent rich solution stream and a second lean liquid stream and separating the first partially vaporized pressurized intermediate solution substream into a second rich vapor stream and a second lean liquid stream and combining the second rich vapor stream with a second pressurized intermediate solution substream to form a partially condensed rich solution stream, where the condensation steps for a two stage condensation process and the second lean liquid stream is used to adjust the composition of the cooled spent rich stream to improve the full condensation of the two stream the intermediate solution stream and the rich solution stream.

Systems

Embodiments of the present invention provide systems for extracting thermal energy from heat source streams having initial temperatures between about 200° F. and about 500° F., where coolant stream used to condense cycle streams have relatively high temperatures greater than or equal to about 80° F., where the systems have overall energy extraction efficiencies that are at least 40% higher than a corresponding Rankine cycle and at least 10% higher than inventor's prior cycle SG-2c disclosed in U.S. Pat. Nos. 6,769,256, 6,941,757, 6,910,334 and 7,065,969.

Vaporization Subsystem

Embodiments of the present invention provide systems that include a vaporization and energy extraction subsystem including a plurality of heat exchange units (HE2, HE3, HE4, HE5 and HE6), a gravity separator (SP2), a throttle valve (TV2), and at least one turbine (T1). The vaporization and energy extraction subsystem preheats, partially vaporizes, and separates a partially vaporized higher pressure rich solution stream with heat from a heat source stream and from a spent rich solution stream to form a rich vapor stream and a lean liquid stream in the preheater HE2 and the heat exchanges units HE3, HE4, HE5 and HE6. The vaporization and energy extraction subsystem also adds a portion of the lean liquid stream into the rich vapor stream to adjust its liquid content to form a richer solution stream, fully vaporizing and slightly superheating the richer solution stream in the heat exchange unit HE6, converts a portion of the thermal energy of the fully vaporizing and slightly superheated richer solution stream into a usable form of energy in the turbine T1, and pressure adjusts the remainder of the lean liquid stream in the throttle control valve TV2, which is then combined with a spent richer solution stream to reform a rich solution stream.

Condensation of Subsystem

The systems also include a condensation subsystem including a plurality of heat exchange units (HE1, HE7 and HE8), a gravity separator (SP1), two pumps (P1 and P2), a throttle valve (TV1), and a coolant pump or fan (CP1/F1). The condensation subsystem supports a two stage condensation process, where streams having two different compositions, a rich solution stream and an intermediate solution stream, are fully condensed using pressurized coolant streams. The condensation subsystem fully condenses a partially condensed rich solution in the first condenser HE1 to form a fully condensed rich solution stream and pressurizes the fully condensed rich solution stream in the first pump P1 to form a fully condensed higher pressure, rich solution stream, which is then forwarded to the vaporization and energy extraction subsystem. Meanwhile, the condensation subsystem fully condenses a partially condensed intermediate solution stream in the eight heat exchange unit, a condenser, HE8 to form a fully condensed intermediate solution stream and then pressurizes the fully condensed intermediate solution stream in the second pump P2 to form a pressurized intermediate solution stream. The condensation subsystem then divides the pressurized intermediate solution stream into two pressurized intermediate substreams and partially vaporizes one of the substreams with heat from an intermediate stream in the seventh heat exchange unit HE7 to form a partially vaporized intermediate solution substream and a partially condensed intermediate solution stream. The condensation subsystem then separates the partially vaporized intermediate solution substream in the gravity separator SP1 to form a rich vapor stream and a lean liquid stream. The condensation subsystem also pressure adjusts the lean liquid stream in the throttle valve TV1 and combines the pressure adjusted intermediate substream with the cooled rich solution stream from the vaporization and energy extraction subsystem to form the intermediate solution stream. The condensation subsystem further combines the second pressurized intermediate solution substream and the rich vapor stream to form the partially condensed rich solution stream.

BRIEF DESCRIPTION OF THE DRAWINGS

The invention can be better understood with reference to the following detailed description together with the appended illustrative drawings in which like elements are numbered the same:

FIG. 1 depicts an embodiment of a system of this invention designated SG-9c.

DEFINITIONS USED IN THE INVENTION

The term "substantially" means that the value of the value or property that the term modifies is within about 10% of the related value or property. In other embodiments, the term means that the value or property is within 5% of the related value or property. In other embodiments, the term means that the value or property is within 2.5% of the related value or property. In other embodiments, the term means that the value or property is within 1% of the related value or property.

The term "slightly" means that the value or property is within about 10% of the related value or property. In other embodiments, the term means that the value or property is within 5% of the related value or property. In other embodiments, the term means that the value or property is within 2.5% of the related value or property. In other embodiments, the term means that the value or property is within 1% of the related value or property.

DETAILED DESCRIPTION OF THE INVENTION

The inventor has found that a system and thermodynamic cycle can be constructed for heat source stream having initial temperatures between about 200° F. and about 500° F. and for coolant streams having a relatively high temperature greater than or equal to 80° F. This makes the system well suited for use in geothermal applications in tropical and subtropical climates. The inventor has also found that by adjusting the liquid content of the richer solution stream prior to the stream being fully vaporized and slightly superheated, the overall energy extraction efficiency of the present cycles may be increased by at least 40% compared to an analogous Rankine cycle and at least 10% compared to the inventor's prior cycle SG-2c disclosed in U.S. Pat. Nos. 6,769,256, 6,941,757, 6,910,334 and 7,065,969. In other embodiments, the efficiency of the cycles are at least 45% more efficient than a corresponding Rankine cycle and at least 11% more efficient than inventor's prior cycle SG-2c disclosed in U.S. Pat. Nos. 6,769,256, 6,941,757, 6,910,334 and 7,065,969. In other embodiments, the efficiency of the methods of this invention are at least 45% more efficient than a corresponding Rankine cycle and at least 12% more efficient than inventor's prior cycle SG-2c disclosed in U.S. Pat. Nos. 6,769,256, 6,941,757, 6,910,334 and 7,065,969. In other embodiments, the efficiency of the methods of this invention are at least 45% more efficient than a corresponding Rankine cycle and at least 13% more efficient than inventor's prior cycle SG-2c disclosed in U.S. Pat. Nos. 6,769,256, 6,941,757, 6,910,334 and 7,065,969. In other embodiments, the efficiency of the methods of this invention are at least 48% more efficient than a corresponding Rankine cycle and at least 14% more efficient than inventor's prior cycle SG-2c disclosed in U.S. Pat. Nos. 6,769,256, 6,941,757, 6,910,334 and 7,065,969.

Embodiments of the present invention broadly relate to methods for extracting thermal energy from heat source streams having initial temperatures between about 200° F. and about 500° F., where coolant stream used to condense cycle streams have relatively high temperatures greater than or equal to about 80° F. The methods include the steps of fully condensing an intermediate solution stream and fully condensing a rich solution stream using a pressurized coolant stream. The methods also include the steps of increasing a pressure of the fully condensed rich solution stream to form a fully condensed higher pressure rich solution stream and increasing a pressure of the fully condensed intermediate solution stream to a pressure slightly in excess of the pressure of the fully condensed higher pressure rich solution stream to form a fully condensed pressurized intermediate solution stream. The methods also include the steps of: (1) dividing the fully condensed pressurized intermediate solution stream into two substream; (2) forwarding one of the intermediate solution substreams through a seventh heat exchange unit to partially vaporize the intermediate substream, while partially condensing an intermediate solution stream; (3) forwarding the partially vaporized intermediate substream to a first gravity separator forming a rich vapor stream and a lean liquid stream; (4) adjusting the pressure of the lean liquid stream to a pressure of a cooled rich solution stream; (5) combining the pressure adjusted lean liquid stream with the cooled rich solution stream to from the intermediate solution stream; and (6) combining the rich vapor stream and the second intermediate solution to form a pre-condensed rich solution stream.

The methods also include the steps of preheating the fully condensed higher pressure rich solution stream with heat from a heat source stream and then dividing the pre-heated higher pressure rich solution stream into two substream. The methods also includes partially vaporizing the first higher pressure rich solution substream with heat from the heat source stream, while the second higher pressure rich solution substream is partially vaporized with heat from the rich solution stream, which comprises a mixture of the spent richer solution stream and a pressure adjusted lean liquid from a second gravity separator to form the cooled rich solution stream. The methods also include combining the two higher pressure partially vaporized rich solution substreams and further vaporizing the combined higher pressure partially vaporized rich solution stream with heat the form the heat source stream to form a further vaporized higher pressure rich solution stream and forwarding the further vaporized higher pressure rich solution stream into the second gravity separator. The methods also include separating the further vaporized higher pressure rich solution stream into a rich vapor stream and a lean liquid stream. The methods also include mixing a portion of the lean liquid stream into the rich vapor stream to form a richer solution stream having a sufficient amount of liquid content so that the resulting richer solution stream may be fully vaporized and slightly superheated with heat from the heat source stream, which results in a lowering of a temperature of the further vaporized higher pressure rich solution stream. The methods may also include adjusting the liquid content of the richer solution stream so that a quantity of the fully vaporized and superheated richer solution stream may be increased improving the overall energy extraction efficiency of the methods. The methods also include converting a portion of the thermal energy of the fully vaporized and superheated richer solution stream in a turbine into a usable form of energy (mechanical and/or electrical) to form a spend richer solution stream.

Embodiments of the present invention broadly relate systems that include a vaporization and energy extraction subsystem including a plurality of heat exchange units for heating, a second gravity separator, a throttle valve, and at least one turbine. The vaporization and energy extraction subsystem preheats, partially vaporizes, and separates the partially vaporized higher pressure rich solution stream to form a rich vapor stream and a lean liquid stream. The vaporization and energy extraction subsystem also adds a portion of the lean liquid stream into the vapor stream to adjust its liquid content to form a richer solution stream, fully vaporizing and slightly superheating the richer solution stream, converts a portion of the thermal energy of the fully vaporizing and slightly superheating the richer solution stream into a usable form of energy, and pressure adjusts the remainder of the lean liquid stream, which is combined with a spent richer solution stream to reform a rich solution stream. The systems also include a condensation subsystem including a plurality of heat exchange units, a first gravity separator, two pumps, a throttle valve, and a coolant pump or fan. The condensation subsystem supports a two stage condensation process, where streams having two different compositions, a rich solution stream and an intermediate solution stream, are fully condensed using pressurized coolant streams. The fully condensed rich solution stream is pressurized to a higher pressure and forwarded to the vaporization and energy extraction subsystem, while the intermediate solution stream is pressurized and divided into two intermediate substreams. One of the substreams is partially vaporized with heat from a cooled intermediate stream to form a partially vaporized intermediate solution substream, which is forwarded to the first gravity separator to for a rich vapor stream and a lean liquid stream. The lean liquid stream is pressure adjusted and combined with the cooled rich solution stream. The vapor stream is then combined with the second pressurized intermediate solution substream to form a pre-condensed rich solution stream.

The working fluid used in the systems of this invention are multi-component fluids comprising a lower boiling point component and a higher boiling point component. Suitable multi-components fluids include, without limitation, ammonia-water mixtures, mixtures of two or more hydrocarbons, mixtures of two or more freon, mixtures of hydrocarbons and freons, or mixtures thereof. In general, the fluid may comprise mixtures of any number of compounds with favorable thermodynamic characteristics and solubility. In certain embodiments, the multi-component fluid comprises a mixture of water and ammonia.

It should be recognized by an ordinary artisan that at those points in the systems of this invention where a stream is split into two or more sub-streams, dividing valves that affect such stream splitting are well known in the art and may be manually adjustable or dynamically adjustable so that the splitting achieves the desired stream flow rates and system efficiencies. Similarly, when stream are combined, combining valve that affect combining are also well known in the art and may be manually adjustable or dynamically adjustable so that the splitting achieves the desired stream flow rates and system efficiencies.

DETAILED DESCRIPTION OF THE DRAWINGS

The SG-9c Embodiment

Referring now to FIG. 1, the system SG-9c operates as follows. A fully condensed rich solution stream S1 having parameters as at a point 1 is pumped to a desired higher pressure by a feed pump P1 to form a higher pressure rich solution stream S2 having parameters as at a point 2, which corresponds to a state of subcooled liquid. The rich solution stream S2 includes a higher concentration of the lower boiling component. Thereafter, the stream S2 passes a preheater or second heat exchange unit HE2, where it is heated in counterflow with a heat source fluid stream S513 having parameters as at a point 513 to form a spent heat source stream S502 having parameters as at a point 502 and a preheated higher pressure rich solution stream S3 having parameters as at a point 3, which corresponds to a state of saturated liquid.

The stream S3 is then divided into two substreams S4 and S5, having parameters as at points 4 and 5. The stream S5 then passes through a recuperative boiler-condenser or third heat exchange unit HE3, where it is heated and partially vaporized in counterflow with an intermediate solution stream S20 having parameters as at a point 20 in a heat exchange process 20-21 or 5-7 (see below) to form a partially vaporized higher pressure rich solution substream S7 having parameters as at a point 7, which corresponds to a state of vapor-liquid mixture and a cooled, rich solution stream S21 having the parameters as at a point 21.

Meanwhile, the substream S4 is sent into a fourth heat exchange unit HE4, where it is heated in counterflow with the heat source stream S512 having parameters as at a point 512 in a heat exchange process 512-513 or 4-6 to form a partially vaporized higher pressure rich solution substream S2 having parameters as at a point 6, which corresponds to a state of vapor-liquid mixture and the heat source stream S513 having the parameters 513.

The streams S6 and S7 are then combined to form a combined partially vaporized, higher pressure rich solution stream S6 having parameters as at a point 10. The stream S10 is then sent into a boiler or fifth heat exchange unit HE5, where it is fully or partially vaporized in counterflow with the heat source stream S511 having parameters as at a point 511 in a heat exchange process 511-512 or 10-11 to form a fully or partially vaporized, higher pressure rich solution stream S11 having parameters as at a point 11 and the heat source stream S512 having the parameters as at the point 512. In this embodiment, the parameters of the stream S11 correspond to a state of liquid-vapor mixture—partially vaporized stream.

The stream S11 is then sent into a second gravity separator SP2, where it is separated into a SP2 saturated rich vapor stream S13 having parameters as at a point 13 and a SP2 saturated lean liquid stream S12 having parameters as at a point 12.

In actual operation, the gravity separator SP2 cannot fully separate the stream S11 in a pure vapor stream and a pure liquid stream. Therefore, the SP2 rich vapor stream S13 from the separator SP2 will always contain some small amount of liquid. If the liquid concentration in stream S13 is sufficient, then all of the stream S12 may be forwarded directly through the second throttle valve TV2 as described in the description of FIG. 1 below. In this embodiment, the stream S12 is divided into two substreams S14 and S15 having parameters as at points 14 and 15.

The substream S14 is combined with the SP2 rich vapor stream S13 to form a stream S16 having parameters as at a point 16, which corresponds to a state of vapor with an effective, but small, amount of liquid in it. In actual operation, the stream S14 may be used to fine tune the system to produce more power at a lower pressure, because at a lower operating pressure, more vapor may be produced and a greater vapor flow to the turbine T1. Thus, by controlling the amount of liquid in the stream S13, the system may be fine tuned increasing a total flow rate of the vapor stream S7.

If we increase temperature of the stream S11 and therefore the temperature of the second gravity separator SP2, we would be able to produce more vapor, but this would require much more much heat than the heat source stream can deliver in the heat exchange process 10-11 or 511-512. Therefore, by adjusting an amount of the lean liquid stream S14 added to the vapor stream S13, we lower the temperature of the stream S11, which simultaneously improves a load efficiency of the fifth heat exchange unit HE5 and the sixth heat exchange unit HE6 maximizing the use of the heat in the heat source stream S500 and maximizing the richer solution stream S16 that is then fully vaporized and slightly superheated in the sixth heat exchange unit HE6.

In certain embodiments, the liquid concentration in the stream S13 is sufficient without having to add additional liquid and the flow rate of the stream S14 falls to zero and all of the stream S12 is sent directly into the second throttle valve TV2 to form the pressure adjusted stream S19 having the parameters as at the point 19, which is then combined with the spent stream S18 to form the stream S20. Depending on the efficiency of the separator SP2, the amount of the SP2 lean liquid stream S14 that is added will vary. Thus, the system is capable of being fined tuned by adjusting the flow rate of the stream S14 that mixes with the stream S13 to form the stream S16, which is then passed into the sixth heat exchange unit HE6. By adjusting the liquid concentration in the S13, the temperature of the stream S11 may be lowered and as the stream S16 passing through the sixth heat exchange unit HE6, it is fully vaporized and slightly superheated to produce more power at a lower pressure, because at a lower operating pressure, more vapor may be produced and a greater vapor flow to the turbine T1.

In any event, the stream S16, which corresponds to wet vapor, is then passed through a superheater or a sixth heat exchange unit HE6, where it is fully vaporized and slightly superheated in counterflow with the heat source stream S500 having parameters as at a point 500 to form the fully vaporized and slightly superheated stream S17 having parameters as at a point 17, which corresponds to a state of slightly superheated vapor. In this embodiment, the stream S17 has a composition that is richer—higher in the lower boiling component—than the composition of the rich solution streams S27, S1-S7, and S10-S11.

The stream S17 is then passed through a turbine T1, where it is expanded producing work and converting a portion of its thermal energy into a usable form of energy, either mechanical or electrical, to form a spent stream S18 having parameters as at a point 18, which corresponds to a state of wet vapor.

Meanwhile, the substream S15 is sent into the second throttle valve TV2, where its pressure is reduced to a pressure equal to a pressure of the spent stream S18, to form a pressure adjusted lean stream S19 having parameters as at a point 19.

The streams S18 and S19 are then combined, to form a stream S20 having parameters as at a point 20, which corresponds to a state of liquid-vapor mixture. The composition of the stream S20 is the same as the composition of the initial rich solution stream S1 having the parameters as at the point 1.

The stream S20 is then sent into the third heat exchange unit HE3, where it condenses providing heat for the heat exchange process 5-7 and 20-11 as described above to form a stream S21 having parameters as at a point 21, corresponding to a state of liquid-vapor mixture.

The stream S21 is then combined with a pressure adjusted lean stream S31 having parameters as at a point 31 to form an intermediate solution stream S22 having parameters as a point 22, which corresponds to a state of liquid-vapor mixture.

The stream S22 is then sent into a seventh heat exchange unit HE7, where it is further cooled and condensed in counterflow with an intermediate solution stream S26 in a heat exchange process 26-36 or 22-23 to form a partially condensed intermediate solution stream S23 and a partially vaporized intermediate solution stream S36 having parameters as at a point 23. The composition of the streams S22 and S23 has a substantially leaner composition than the composition of the rich solution stream S1, and therefore, is condensed at a coolant temperature that is at substantially lower pressure than would be possible using the rich solution stream S1.

The intermediate solution stream S23 now enters into a condenser or eighth heat exchange unit HE8, where it is cooled in counterflow with a coolant stream S54 having parameters as at a point 54 in a heat exchange process 23-24 or 54-55 to form a fully condensed intermediate solution stream S24 having parameters as at a point 24, which corresponds to a state of saturated liquid and a spent coolant stream S55 having parameter as at a point 55.

The stream S24 is then pumped by a pump P2, to a pressure that slightly exceeds the pressure of the rich solution stream S1 having the parameters as at the point 1 as described above to form a higher pressure, fully condensed intermediate solution stream S25 having parameters as at a point 25, which corresponds to a state of subcooled liquid.

The intermediate solution stream S25 is then divided into two intermediate solution substreams S26 and S33 having parameters as at points 26 and 33, respectively.

The stream S26 is then sent into the seventh heat exchange unit HE7, in counterflow with the stream S22 in the heat exchange process 22-23 or 26-36 to form a partially vaporized, intermediate solution stream S36 and the partially condensed intermediate solution stream S23 as described above. The stream S26 is initially heated in the seventh heat exchange unit HE7 obtaining parameters corresponding to a state of saturated liquid. Thereafter, the stream S26 is partially vaporized in the remainder of the seventh heat exchange unit HE7 to form the stream S36.

Meanwhile as the stream S22 passes through the seventh heat exchange unit HE7, the stream S22 obtains parameters that are the same or substantially the same as the parameters of the stream S26 corresponding to a state of saturated liquid.

The stream S36, which is in a state of liquid-vapor mixture, is now sent into a first gravity separator SP1, where it is separated into a saturated rich vapor stream S32 having parameters as at a point 32 and a saturated lean liquid stream S30 having parameters as at a point 30.

The stream S30 is then sent into a first throttle valve TV1, where its pressure is reduced to a pressure equal to the pressure of the stream S21 having the parameters as at the point 21, to form the pressure adjusted lean stream S31 having the parameters as at the point 31. The streams S21 and S31 are then combined, forming the intermediate solution S22 having the parameters as at the point 22 as described above.

Meanwhile, the composition of the stream S32 is richer than the compositions of the rich solution stream S1—has a higher concentration of the lower boiling component of the multi-component fluid. The stream S32 is then combined with the stream S33 to form a mixed liquid-vapor rich solution stream S27 having parameters as at a point 27, which corresponds to a state of liquid-vapor mixture. The stream S27 is the first rich solution stream in the cycle.

The stream S27 is then sent into a condenser or the first heat exchange unit HE1, where it is cooled in counterflow by a coolant stream S52 in a heat exchange step 52-53 or 27-1 to form the fully condensed, rich solution stream S1 having the parameters as at the point 1 as described above and a spent coolant stream S53 having parameters as at a point 53.

With regards to the coolant or the cooling media, the coolant (air or water) stream S50 having the initial parameters as at a point 50 is pumped by a coolant pump CP1 to an elevated pressure forming a coolant stream S51 having parameters as at a point 51.

The stream S51 is then divided into the two coolant substreams S52 and S54 having the parameters as at the point 52 and 54, respectively, which are sent into the eighth heat exchange unit HE8 and the first heat exchange unit HE1, respectively as described above. Upon exiting the eighth heat exchange unit HE8, the stream S54 is converted into the spent coolant stream S55 having the parameters as at the point 55. Upon exiting the first heat exchange unit HE1, the stream S52 is converted into the spent coolant stream S53 having the parameters as at the point 53. In both cases, streams S52 and S54 act as coolant for the heat exchange processes 52-53 or 27-1 and 23-24 or 54-55, respectively.

Embodiments of the present system have the specific feature that the condensation of the multi-component working fluid is performed in two steps. Initially, the streams S18 or S20 having the parameters as at the points 18 and 20, respectively, returning from the turbine T1 is mixed with the lean stream S31 having the parameters as at the point 31 from the first separator SP1 forming the stream S22, which is substantially leaner than the streams S18 and S20 from the turbine T1. This allows the stream S22 to be condensed at a substantially lower pressure than would be possible with a richer stream of multi-component working fluid such as the stream S20. As a result, a back pressure of the turbine T1 is lowered, increasing a power output of the turbine T1 and thereby increasing the efficiency of the overall system.

In the second condensation stage, the intermediate solution stream S24 is partially re-boiled in the seventh heat exchange unit HE7 and the composition of the working fluid is restored to a rich solution composition and then finally fully condensed in HE1 to form the fully condensed rich solution stream S1 having the parameters as at the point 1.

This embodiment of the system of this invention includes seven different compositions for the multi-component working fluid as shown in Table I.

TABLE I

Stream and Compositions for FIG. 1

| Stream | Composition |
|---|---|
| S13 | SP2 rich vapor |
| S32 | SP1 rich vapor |
| S16-S18 | richer solution |
| S1-S7, S10-S11, S20-S11 and S27 | rich solution |
| S22-S26, S33 and S36 | intermediate solution |
| S12, S14, S15 and S19 | SP2 lean liquid |
| S30-S31 | SP1 lean liquid |

This embodiment of the system operates on three dominate stream compositions, the richer solution, the rich solution, and the intermediate solution compositions, while the separator streams are used to change certain stream compositions into other stream compositions.

The system of FIG. 1 is a closed cycle.

The embodiment SG-9c shown in FIG. 1, where the stream S12 is divided into the substream S14 and S15 to adjust the liquid content of the SP1 rich vapor stream S13, was used in process software to properly model the system behavior. As a result of adjusting the liquid content of the stream S13, as compared to prior systems such as SG-2, especially SG-2a, described in U.S. Pat. Nos. 6,769,256, 6,941,757, 6,910,334 and 7,065,969, the present system outperforms these prior systems in tropical conditions or efficiencies by between about 11% and about 14%.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

I claim:

1. A method comprising:

partially vaporizing a fully condensed higher pressure rich solution stream using heat from a heat source stream and a spent rich solution stream to form a spent heat source stream, a cooled spent rich solution stream, and a further partially vaporized higher pressure rich solution stream, separating the further partially vaporized higher pressure rich solution stream in a first gravity separator (SP2) into a first rich vapor stream and a first lean liquid stream, adjusting a liquid content of the first rich vapor stream by adding a portion of the first lean liquid stream into the first rich vapor stream to form a richer solution stream so that a quantity of the richer solution stream is increased improving an overall energy extraction efficiency of the method to an efficiency at least 40% higher than analogous Rankine cycle method and to lower a temperature of the further partially vaporized higher pressure rich solution stream, fully vaporizing and slightly superheating the richer solution stream in a sixth heat exchange unit (HE6), converting a portion of the heat associated with the vaporized and slightly superheated richer solution stream in a turbine (T1) into a useable form of energy with the improved efficiency, combining a pressure adjusted remainder of the first lean liquid stream into a spent richer solution stream to form the spent rich solution stream, partially vaporizing a first pressurized intermediate solution substream with heat from an intermediate solution stream comprising the cooled spent rich solution stream and a second lean liquid stream in a seventh heat exchange unit (HE7) to form a partially vaporized first pressurized intermediate solution substream and a partially condensed intermediate solution stream, fully condensing the partially condensed intermediate solution stream using a pressurized coolant stream in an eighth heat exchange unit or condenser (HE8) to form a fully condensed intermediate solution stream, fully condensing a rich solution stream using the pressurized coolant stream in a first heat exchange unit or condenser (HE1) to form a fully condensed rich solution stream, increasing a pressure of the fully condensed rich solution stream using a first pump (P1) to form the fully condensed higher pressure rich solution stream, increasing a pressure of the fully condensed intermediate solution stream using a second pump (P2) to form a fully condensed pressurized intermediate solution stream having a pressure slightly higher than the pressure of the fully condensed higher pressure rich solution stream, separating the partially vaporized first pressurized intermediate solution substream in a first second gravity separator (SP1) into a second rich vapor stream and the second lean liquid stream, and combining the second rich vapor stream with a second pressurized intermediate solution substream to form the rich solution stream, where the second lean liquid stream adjusts a composition of the cooled spent rich solution stream to improve the full condensation of the intermediate solution stream and the rich solution stream.

2. The method of claim 1, wherein the partially vaporizing step comprises:

preheating the fully condensed higher pressure rich solution stream in a second heat exchange unit (HE2) with heat from the heat source stream to form a preheated higher pressure rich solution stream, dividing the preheated higher pressure rich solution stream into a first preheated higher pressure rich solution substream and a second preheated higher pressure rich solution substream, partially vaporizing the first preheated higher pressure rich solution substream in a third heat exchange unit (HE3) with heat from the spent rich solution stream to form a partially vaporized first higher pressure rich solution substream, partially vaporizing the second preheated higher pressure rich solution substream in a fourth heat exchange unit (HE4) with heat from the heat source stream to form a partially vaporized second higher pressure rich solution substream, combining the partially vaporized first and second higher pressure rich solution substreams to form a partially vaporized higher pressure rich solution stream, and further vaporizing the partially vaporized higher pressure rich solution stream in a fifth heat exchange unit (HE5) to form the further partially vaporized higher pressure rich solution stream.

3. The method of claim 1, wherein the streams are composed of a multi-component fluid comprising a lower boiling point component and a higher boiling point component.

4. The method of claim 3, wherein the multi-component fluid is selected from an ammonia-water mixture, a mixture of two or more hydrocarbons, a mixture of two or more freon, a mixture of hydrocarbons and freons, and mixtures thereof.

5. The method of claim 4, wherein the multi-component fluid comprises a mixture of water and ammonia.

6. A system comprising:

a vaporization and energy extraction subsystem including a plurality of heat exchange units (HE2, HE3, HE4, HE5 and HE6), a gravity separator (SP2), a throttle valve (TV2), and at least one turbine (T1), where the heat exchange units (HE2, HE3, HE4, HE5 and HE6), the gravity separator (SP2), the throttle valve (TV2), and the at least one turbine (T1) are configured so that:

a higher pressure, fully condensed rich solution stream is preheated and partially vaporized with heat from a heat source stream and from a spent rich solution stream in the preheater (HE2) and the heat exchanges units (HE3, HE4, and HE5) and separated to form a first rich vapor stream and a first lean liquid stream in the gravity separator (SP2), a portion of the first lean liquid stream is added into the first rich vapor stream to adjust its liquid content to form a richer solution stream so that a quantity of the richer solution stream is increased improving an overall energy extraction efficiency of the system to an efficiency at least 40% higher than analogous Rankine cycle method and lowering a temperature of the partially vaporized higher pressure rich solution, the richer solution stream is fully vaporized and slightly superheated in the heat exchange unit (HE6), a portion of the thermal energy of the fully vaporized and slightly superheated richer solution stream is converted into a usable form of energy in the at least one turbine (T1), a remainder of the first lean liquid stream is pressure adjusted in the throttle control valve (TV2), and a spent richer solution stream and a pressure adjusted remainder of a first lean liquid stream are combined to reform a spent rich solution stream, and a condensation subsystem including a plurality of heat exchange units (HE1, HE7 and HE8), a gravity separator (SP1), two pumps (P1 and P2), a throttle valve (TV1), and a coolant pump or fan (CP1/F1), where the condensation subsystem supports a two stage condensation process and the heat exchange units (HE1, HE7 and HE8), the gravity separator (SP1), the two pumps (P1 and P2), the throttle valve (TV1), and the coolant pump or fan (CP1/F1) are configured so that:

a partially condensed rich solution stream is fully condensed in the first condenser (HE1) to form a fully condensed rich solution stream, the fully condensed rich solution stream is pressurized in the first pump (P1) to form the higher pressure, fully condensed rich solution stream, which is then forwarded to the vaporization and energy extraction subsystem, a partially condensed intermediate solution stream is fully condensed in the eighth heat exchange unit, a condenser (HE8) to form a fully condensed intermediate solution stream, the fully condensed intermediate solution stream is pressurized in the second pump (P2) to form a pressurized intermediate solution stream, the pressurized intermediate solution stream is divided into a first pressurized intermediate solution substream and a second pressurized intermediate solution substream;

the first pressurized intermediate solution substream is partially vaporized with heat from an intermediate stream in the seventh heat exchange unit (HE7) to form a partially vaporized intermediate solution substream and the partially condensed intermediate solution stream, the partially vaporized intermediate solution substream is separated in the gravity separator (SP1) to form a second rich vapor stream and a second lean liquid stream, the second lean liquid stream is pressure adjusted in the throttle valve (TV1) to form a pressure adjusted second lean liquid stream, a cooled rich solution stream from the vaporization and energy extraction subsystem is combined with the pressure adjusted second lean liquid stream to form the intermediate stream, and the second pressurized intermediate solution substream and the second rich vapor stream are combined to form the partially condensed rich solution stream.

7. The system of claim 6, wherein the streams are composed of a multi-component fluid comprising a lower boiling point component and a higher boiling point component.

8. The system of claim 7, wherein the multi-component fluid is selected from an ammonia-water mixture, a mixture of two or more hydrocarbons, a mixture of two or more freon, a mixture of hydrocarbons and freons, and mixtures thereof.

9. The system of claim 8, wherein the multi-component fluid comprises a mixture of water and ammonia.

* * * * *